United States Patent [19]

Nguyen et al.

[11] Patent Number: 4,936,931

[45] Date of Patent: Jun. 26, 1990

[54] NITROALKANE-BASED EMULSION EXPLOSIVE COMPOSITION

[75] Inventors: Anh D. Nguyen, Brossard; Alain J. Gagnon, Terrebonne, both of Canada

[73] Assignee: C-I-L Inc., North York, Canada

[21] Appl. No.: 442,695

[22] Filed: Nov. 29, 1989

[30] Foreign Application Priority Data

Dec. 5, 1988 [CA] Canada ..... 584954

[51] Int. Cl.[5] ..... C06G 45/00

[52] U.S. Cl. ..... 149/2; 149/47; 149/62; 149/78; 149/89; 149/90

[58] Field of Search ..... 149/2, 47, 62, 78, 89, 149/90

[56] References Cited

U.S. PATENT DOCUMENTS

| | | | |
|---|---|---|---|
| Re. 28,060 | 7/1974 | Cattermole et al. | 149/2 |
| 3,447,978 | 6/1969 | Bluhm | 149/2 |
| 3,674,578 | 7/1972 | Cattermole et al. | 149/2 |
| 3,715,247 | 2/1973 | Wade | 149/21 |
| 3,765,964 | 10/1973 | Wade | 149/2 |
| 3,770,522 | 11/1973 | Tomic | 149/2 |
| 4,104,092 | 8/1978 | Mullay | 149/2 |
| 4,110,134 | 8/1978 | Wade | 149/2 |
| 4,111,727 | 9/1978 | Clay | 149/2 |
| 4,138,281 | 2/1979 | Olney et al. | 149/2 |
| 4,141,767 | 2/1979 | Sudweeks et al. | 149/2 |
| 4,149,916 | 4/1979 | Wade | 149/56 |
| 4,149,917 | 4/1979 | Wade | 149/56 |
| 4,216,040 | 8/1980 | Sudweeks et al. | 149/21 |
| 4,218,272 | 8/1980 | Brockington | 149/21 |
| 4,231,821 | 11/1980 | Sudweeks et al. | 149/21 |
| 4,708,753 | 11/1987 | Nguyen et al. | 149/2 |

FOREIGN PATENT DOCUMENTS

| | | |
|---|---|---|
| 1096173 | 2/1981 | Canada . |
| 1244463 | 11/1988 | Canada . |

*Primary Examiner*—Stephen J. Lechert, Jr.
*Attorney, Agent, or Firm*—C. Brian Barlow

[57] ABSTRACT

An emulsion explosive composition comprising a discontinuous oxidizer phase and a continuous fuel phase is provided wherein the fuel phase comprises a nitroalkane compound. The composition essentially contains as the emulsifying agent a polyisobutylene succinic anhydride-based compound in admixture with an ester of 1–4 sorbitan and oleic acid. The composition demonstrates high explosive strength and excellent stability.

12 Claims, No Drawings

NITROALKANE-BASED EMULSION EXPLOSIVE COMPOSITION

BACKGROUND OF THE INVENTION

1. Field of the Invention

The present invention relates to explosive compositions of the water-in-fuel emulsion type in which an aqueous oxidizer salt solution is dispersed as a discontinuous phase within a continuous phase of a liquid or liquefiable carbonaceous fuel.

2. Description of the Prior Art

Water-in-fuel emulsion explosives are now well known in the explosives art and have been demonstrated to be safe, economic and simple to manufacture and to yield excellent blasting results. Bluhm, in U.S. Pat. No. 3,447,978, disclosed an emulsion explosive composition comprising an aqueous discontinuous phase containing dissolved oxygen-supplying salts, a carbonaceous fuel continuous phase, an occluded gas and an emulsifier. Since Bluhm, further disclosures have described improvements and variations in water-in-fuel explosive compositions.

These include U.S. Pat. Nos. 3,674,578, Cattermole et al; 3,770,522, Tomic; 3,715,247, Wade; 3,765,964, Wade; 4,110,134, Wade; 4,149,916, Wade; 4,149,917, Wade; 4,141,767, Sudweeks and Jessup; Canadian Patent. No. 1,096,173, Binet and Seto; U.S. Pat. Nos. 4,111,727, Clay; 4,104,092, Mullay; 4,231,821, Sudweeks and Lawrence; 4,218,272, Brockington; 4,138,281, Olney and Wade; and 4,216,040, Sudweeks and Jessup. Mullay, in 4,104,092, describes a jelled explosive composition which is sensitized by means of an emulsion. This composition may contain, as an additional sensitizer, nitromethane, for example. Sudweeks et al, in U.S. Pat. No. 4,141,767, suggest that aliphatic nitro compounds can be used as the fuel phase of an emulsion blasting agent but no example demonstrating utility is provided, nor is any claim made to such a material. Sudweeks et al, again in U.S. Pat. Nos. 4,231,821 and 4,216,040 make reference to aliphatic nitro compounds as fuels for emulsion explosives, but again no examples are provided. Cattermole et al, in U.S. Pat. No. Re. 28,060, suggest that nitroalkanes, such as nitropropane, may be used as the organic fuel continuous phase in an emulsion type blasting agent without any exemplification thereof. Tomic, in U.S. Pat. No. 3,770,522, makes the same unsupported suggestion.

While it has been generally recognized in the art that nitroalkane compounds would be excellent candidates as the fuel phase for emulsion explosives because of their low oxygen value, high energy nature and low price, no useful and stable emulsion explosive containing these fuels has yet been produced for practical application. The principal difficulty in compounding such an explosive has been the failure to discover suitable surfactants to emulsify the nitroalkane in stable emulsion explosives. Heretofore, when used, nitroalkanes have been employed only in small amounts and in combination with conventional oil/wax fuels.

SUMMARY OF THE INVENTION

The present invention provides an emulsion type explosive composition which comprises:

(A) a liquid or liquefiable fuel selected from the group consisting of nitroalkane compounds forming a continuous emulsion phase;

(B) an aqueous solution of one or more inorganic oxidizer salts forming a discontinuous phase; and (C) an effective amount of a PIBSA-based emulsifying agent.

As used hereinafter, the emulsifying compound used and described in (C) above will be referred to as "PIBSA-based emulsifier" and is, preferably, the reaction product of (i) a polyalk(en)yl succinic anhydride which is the addition product of a polymer of a mono-olefin containing 2 to 6 carbon atoms, and having a terminal unsaturated grouping with maleic anhydride, the polymer chain containing from 30 to 500 carbon atoms; and (ii) a polyol, a polyamine, a hydroxyamine, phosphoric acid, sulphuric acid or monochloroacetic acid.

For improved stability, it is desirable to also include a second emulsifier to create an emulsifier mixture of said PIBSA-based emulsifying agent and a mono-, di- or tri-ester of 1–4 sorbitan and oleic acid, or mixtures thereof.

The sorbitan oleate described hereinabove may be in the form of the mono-, di- or tri-esters or may be in the form of sorbitan sesquioleate which comprises a mixture of the mono-, di- or tri-esters and will be referred to as a "sorbitan sesquioleate".

It has been surprisingly discovered that the use of the above-described emulsifier or emulsifier mixture when employed in the production of a water-in-fuel emulsion explosive, wherein the fuel comprises a nitroalkane compound, such as niromethane, nitroethane and nitropropane, results in an explosives composition which exhibits high strength and stability and which retains sensitivity when exposed to shear and shock, even at low ambient temperatures. It is postulated that when used in an effective ratio, the sorbitan sesquioleate component of the emulsifier mixture principally acts to emulsify the aqueous and fuel phases and, thereafter, the PIBSA-based component of the emulsifier mixture penetrates the micellar structure and functions to anchor or stabilize the formed emulsion. The requirement of stability is essential to the production of a practical explosive product since, if the emulsion destabilizes or breaks down, useful explosive properties are lost as the compositions often become non-detonatable.

The amount of emulsifier or emulsifier mixture used in the emulsion explosive of the invention will range from 1.5% to 10% by weight of the total composition, preferably, from 1.5% to 4% by weight of the total composition. The ratio of the sorbitan ester emulsifier to the PIBSA-based emulsifier in the mixture may range from 1:1 to 1:10 and is, preferably, in the range of from 1:1 to 1:5.

The novel water-in-fuel emulsion explosive of the present invention utilizing nitroalkane compounds as the fuel phase demonstrates a number of advantages over conventional emulsion explosives employing aliphatic hydrocarbon oils or waxes as the fuel phase. The emulsion explosive of the present invention exhibits great explosive strength or energy, has stability over long periods of storage even at low temperatures and demonstrates resistance to shock and shear. Very fine droplet size is achieved and, hence, close contact of the salt and fuel phases at a sub-micron level is provided for. Balance for oxygen demand is easily accomplished and, hence, total consumption of the ingredients occurs during detonation with little noxious fume production.

The composition has the ability to be tailored in consistency from a soft to a hard composition depending on packaging requirements and/or end use.

The invention is illustrated by the following examples wherein the various compositions were compounded using a jacketed Hobart (TM) mixer. In the mixing procedure employed, the emulsifier mixture and the nitroalkane fuel which constitute the continuous emulsion phase, were measured by weight and heated in the mixer bowl to a temperature between 80° and 100° C. The discontinuous aqueous phase comprising a solution of 77 parts by weight of ammonium nitrate, 11 parts by weight of sodium nitrate and 12 parts by weight of water was added slowly to the heated fuel in the mixer bowl while the mixer was operated at moderate speed (Speed 2). An emulsion was seen to form instantaneously between the phases. After 5 minutes of mixing, the machine speed was increased (Speed 3) for 5 additional minutes to provide further refining. When mixing was completed, glass microballoons or chemical gassing agents were added by manual mixing. The final product was packaged in plastic tubes at ambient temperature and subjected to various testing procedures to measure the following characteristics:

Oxygen Balance (OB)—The OB value of each composition is calculated based on the oxygen value of each ingredient in the composition. Explosives are normally formulated in the OB range of 0 to −2.0 to avoid the production of excessive fumes upon detonation.

Relative weight strength (RWS)—RWS is the relative strength of the explosive based on ANFO taken at 100. The RWS of a conventional emulsion explosive devoid of added fuel is about 80, or 80% strength of ANFO.

Density (g/cc)—The density of an emulsion is measured on the cartridged explosive. Without added microballoons or gassing agents, the emulsion density is about 1.40 to 1.45 g/cc. The highest density at which an emulsion retains its sensitivity to an electric blasting cap (EB) is around 1.30 to 1.35 g/cc.

Hardness $P_{22}$—The hardness of an emulsion is measured by the penetration cone test. The higher the value, the softer is the emulsion. In practice, an emulsion with $P_{22}$ above 150 is considered to be soft and can be packaged in plastic film only. With $P_{22}$ from 80 to 130, emulsion is relatively hard and can be packaged in paper shells.

Shear sensitivity—The shear sensitivity of an emulsion is determined by the rolling pin test. A sample of emulsion, approximately 25 mm diameter, 50 mm long, is flattened to 5 mm thick by a rolling pin in a consistent and reproducible manner. Upon flattening, emulsion droplets are broken and crystallized resulting in a temperature rise. By recording the temperature rise at different testing temperatures, a plot of temperature rise $\Delta T$ versus testing temperatures T can be constructed. The rise in shear temperature ($T_{16}$) value is the temperature at which emulsion increases 16° C. in the rolling pin test. It is determined from the $\Delta T$ versus T curve. In practical use, the $T_{16}$ value is used to compare the stability to shear the shock of one emulsion with another. A low $T_{16}$ value means that an emulsion is more stable to shear than those with higher $T_{16}$ value. For the Canadian climate for example, $T_{16}$ values below −17° C. are satisfactory to ensure that emulsion does not crystallize in handling and transportation in cold weather.

Droplet size—Emulsion droplet size is determined by measuring individual droplets on 1250 magnification microscopic photographs. Smaller droplets often enhance the emulsion stability, especially in cold storage.

The examples shown in Table I, below, show typical compositions of emulsified nitroalkane fueled explosives. Nitromethane, nitroethane, or nitropropane are used in the continuous phase to replace conventional paraffin oils or waxes. The surfactant is a mixture of a PIBSA-based emulsifier and sorbitan sesquioleate. The aqueous phase is a standard AN/SN/water solution containing 77% AN, 11% SN and 12% water. Unless otherwise indicated, the PIBSA-based emulsifier used in the examples is the reaction product of polyisobutyl succinic anhydride and diethanolamine.

Stable emulsions were obtained for all examples. The compositions are not sticky and have adequate shear stability ($T_{16}$ below −20° C.) and sensitivity (R6–7). Nitromethane and nitroethane based emulsions exhibit finer droplets (0.6 to 0.9μ) than does nitropropane based emulsion.

TABLE I

| | Mix 1 | Mix 2 | Mix 3 | Mix 4 | Mix 5 |
|---|---|---|---|---|---|
| PIBSA-based emulsifier | 2.0 | 2.0 | 2.0 | 2.0 | 2.0 |
| Sorbitan sesquioleate | 0.5 | 0.5 | 0.5 | 0.5 | 0.5 |
| Nitromethane | 23.0 | — | — | — | — |
| Nitroethane | — | 3.0 | 10.0 | 7.5 | — |
| Nitropropane | — | — | — | — | 10.0 |
| AN/SN liquor | 70.5 | 90.5 | 84.0 | 86.5 | 84.0 |
| Microballoons-glass* | 4.0 | 4.0 | 3.5 | 3.5 | 3.5 |
| Density, g/cc | 1.10 | 1.10 | 1.17 | 1.17 | 1.17 |
| Hardness | 140 | 166 | 195 | 220 | 192 |
| Rise in shear temperature °C. | −28 | −22 | −20 | −21 | −23 |
| Droplet size μ | | | | | |
| average $\bar{X}$ | 0.62 | 0.67 | 0.85 | 0.90 | 1.16 |
| % below 1 | 96.7 | 94.7 | 74.8 | 65.7 | 50.9 |
| Minimum Primer | R6(1) | R6 | R7(2) | R7 | R7 |
| VOD km/sec | 4.1 | 4.3 | 4.2 | 4.0 | 3.9 |

*B23 microballoons from 3M Company
(1) Contains 0.1 grams lead azide and 0.15 grams PETN base charge.
(2) Contains 0.1 grams lead azide and 0.20 grams PETN base charge.

The Examples shown in Table II, below, demonstrate the effect of increasing nitromethane content on emulsion properties. With 3% nitromethane, the oil phase was not rich enough to form emulsion. However, with 6% nitromethane or above, a stable emulsion with good explosive properties was formed.

The results also indicated that with increasing nitromethane in the continuous phase, the emulsion becomes harder and droplets became somewhat finer. Since the shear sensitivity at 6% nitromethane or above was excellent ($T_{16}$ −27° C.), no significant gain in shear stability was observed.

TABLE II

| | Mix 6 | Mix 7 | Mix 8 | Mix 9 | Mix 10 |
|---|---|---|---|---|---|
| PIBSA-based emulsifier | 2.0 | 2.0 | 2.0 | 2.0 | 2.0 |
| Sorbitan sesquioleate | 0.5 | 0.5 | 0.5 | 0.5 | 0.5 |
| Nitromethane | 3.0 | 6.0 | 12.0 | 18.0 | 23.0 |
| AN/SN liquor | 91.0 | 88.0 | 82.0 | 76.0 | 70.5 |
| Microballoons-glass | 3.5 | 3.5 | 3.5 | 3.5 | 4.0 |
| Density, g/cc | Emulsion | 1.20 | 1.17 | 1.15 | 1.10 |
| Hardness | did not | 168 | 162 | 160 | 140 |
| Rise in shear temperature °C. | form | 27.5 | −27 | −28 | −28 |
| Droplet size μ | | | | | |
| average $\bar{X}$ | | 0.81 | 0.75 | 0.86 | 0.62 |

TABLE II-continued

| | Mix 6 | Mix 7 | Mix 8 | Mix 9 | Mix 10 |
|---|---|---|---|---|---|
| % below 1 | | 79.0 | 81.9 | 76.1 | 96.7 |
| Minimum Primer | | R7 | R7 | R7 | R6 |
| VOD km/sec | | 3.6 | 3.8 | 3.8 | 4.1 |

Tables III and IV, below, demonstrate the effect of the use of different levels of emulsifiers.

With PIBSA-based emulsifier varying from 0.5% to 4.0% with a constant sorbitan sesquiolete at 0.5%, it was found that:

below 1.0%, the PIBSA-based surfactant content was not adequate resulting in unstable emulsions;

above 1.0%, PIBSA-based emulsifier, stable emulsions with good explosive properties were obtained.

With constant amounts of PIBSA-based emulsifier at 2.0% and increasing sorbitan sesquiolate from 0 to 4.0% in compositions, it was found that:

without sorbitan sesquioleate, an emulsion formed but was not stable; and at least 0.5% or higher sorbitan sesquioleate was required to produce a stable emulsion. Higher sorbitan sesquioleate made the emulsion softer and somewhat more stable to shear.

TABLE III

| | Mix 11 | Mix 12 | Mix 13 | Mix 14 | Mix 15 |
|---|---|---|---|---|---|
| PIBSA-based emulifier | 0.5 | 1.0 | 2.0 | 3.0 | 4.0 |
| Sorbitan sesquioleate | 0.5 | 0.5 | 0.5 | 0.5 | 0.5 |
| Nitromethane | 6.0 | 6.0 | 6.0 | 6.0 | 6.0 |
| AN/SN liquor | 89.5 | 89.0 | 88.0 | 87.0 | 86.0 |
| Microballoons-glass | 3.5 | 3.5 | 3.5 | 3.5 | 3.5 |
| Density, g/cc | Emulsion formed | | 1.20 | 1.20 | 1.20 |
| Hardness | but crystallized | | 175 | 177 | 180 |
| Rise in shear temperature °C. | in 2 days | | −27 | −25 | −25 |
| Droplet size μ | | | | | |
| average $\overline{X}$ | 0.66 | 0.80 | 0.81 | 0.85 | 0.91 |
| % below 1 | 93.3 | 79.5 | 79.0 | 75.7 | 67.0 |
| Minimum Primer | EB* | EB | R7 | R6 | R6 |
| VOD km/sec | Failed | Failed | 3.6 | 3.1 | 2.9 |

*Electric blasting cap

TABLE IV

| | Mix 16 | Mix 17 | Mix 18 | Mix 19 | Mix 20 |
|---|---|---|---|---|---|
| PIBSA-based emulsifier | 2.0 | 2.0 | 2.0 | 2.0 | 2.0 |
| Sorbitan sesquioleate | — | 0.5 | 1.0 | 2.0 | 4.0 |
| Nitromethane | 6.0 | 6.0 | 6.0 | 6.0 | 6.0 |
| AN/SN liquor | 88.5 | 88.0 | 87.5 | 86.5 | 84.5 |
| Microballoons-glass | 3.5 | 3.5 | 3.5 | 3.5 | 3.5 |
| Density, g/cc | Emulsion | 1.20 | 1.20 | 1.20 | 1.20 |
| Hardness | formed | 175 | 183 | 190 | 200 |
| Rise in shear temperature °C. | crystallized upon cooling | −27 | −25 | Below −25 | Below −25 |
| Droplet size μ | | | | | |
| average $\overline{X}$ | | 0.81 | 0.78 | 0.79 | — |
| % below 1 | | 79.0 | 81.6 | 83.0 | — |
| Minimum Primer | EB | R7 | R6 | R5(1) | R5 |
| VOD km/sec | Failed | 3.6 | 3.1 | 4.1 | 4.6 |

(1)Contains 0.1 grams lead azide and 0.1 grams petn base charge.

Table V, below, provides examples of the addition of parafin oils, paraffin waxes, microcrystalline wax, synthetic wax, and TNT to nitromethane emulsions. It was observed that:

paraffin oil or paraffin wax (slackwax) enhanced the shear stability of emulsified nitromethane and the emulsion became softer;

microcrystalline and synthetic waxes made the emulsion harder with some loss in shear stability;

TNT could be used with nitromethane in the continuous phase to give emulsion with adequate hardness, adequate shear stability, fine droplet (0.7μ average), and satisfactory explosive properties.

TABLE V

| | Mix 21 | Mix 22 | Mix 23 | Mix 24 | Mix 25 |
|---|---|---|---|---|---|
| PIBSA-based emulsifier | 2.0 | 2.0 | 2.0 | 2.0 | 2.0 |
| Sorbitan sesquioleate | 0.5 | 0.5 | 0.5 | 0.5 | 1.0 |
| Nitromethane | 6.0 | 6.0 | 6.0 | 6.0 | 2.0 |
| Paraffin oil | 2.0 | — | — | — | — |
| Slackwax | — | 2.0 | — | — | — |
| Microcrystalline wax | — | — | 1.3 | — | — |
| Synthetic wax | — | — | 0.7 | — | — |
| TNT | — | — | — | 10.0 | 10.0 |
| AS/SN liquor | 86.0 | 86.0 | 86.0 | 78.0 | 81.0 |
| Microballoons-glass | 3.5 | 3.5 | 3.5 | 3.5 | 4.0 |
| Density, g/cc | 1.20 | 1.20 | 1.20 | 1.20 | 1.20 |
| Hardness | 225 | 210 | 80 | 160 | 155 |
| Rise in shear temperature °C. | Below −30 | Below −30 | −22 | −24 | −26 |
| Droplet size μ | | | | | |
| average $\overline{X}$ | 0.77 | 0.84 | 0.99 | 0.73 | 0.76 |
| % below 1 | 84.2 | 78.7 | 60.7 | 87.6 | 85.5 |
| Minimum Primer | R5 | R6 | R5 | R6 | R7 |
| VOD km/sec | 3.8 | 3.5 | 4.7 | 4.0 | 3.5 |

Table VI, below, shows a typical nitroalkane emulsion explosive containing 23% nitromethane in the continuous phase. The explosive density was made at 1.09 g/cc, 1.17 g/cc and 1.26 g/cc with respectively 4, 3 and 2% glass microballoons. The detonation velocity was measured at cartridge diameter sizes from 18 mm to 50 mm.

It was found that nitromethane emulsion explosives showed satisfactory detonation velocities at density below 1.26 g/cc. The optimal velocities were recorded at around 1.15–1.17 g/cc density, and products began failing at above 1.26 g/cc.

TABLE VI

| | Mix 26 | Mix 27 | Mix 28 |
|---|---|---|---|
| PIBSA-based emulsifier | 2.0 | 2.0 | 2.0 |
| Sorbitan sesquioleate | 0.5 | 0.5 | 0.5 |
| Nitromethane | 23.0 | 23.0 | 23.0 |
| AN/SN liquor | 70.5 | 71.5 | 72.5 |
| Microballoons-glass | 4.0 | 3.0 | 2.0 |
| Density, g/cc | 1.09 | 1.17 | 1.26 |
| VOD m/sec | — | — | — |
| 50 mm diameter | 4601 | 4811 | 4601 |
| 40 mm diameter | 4504 | 4774 | 3547 |
| 25 mm diameter | 4320 | 4472 | 3083 |
| 18 mm diameter | 3692 | 3588 | Failed EB |

Table VII, below, shows basic emulsion explosive compositions based on nitromethane. All the compositions have the oxygen balance slightly negative to meet fume Class I requirement.

In respect of strength, without aluminum fuel as in Mix 29, the explosive is 27.8% higher in strength than conventional oils/waxes emulsions (RWS 101 compared to 79). With added aluminum fuel, the explosive strength could be as high as conventional high strength NG-based products (5% aluminum Mix 30, RWS 112) or higher if desired (9% aluminum, RWS 121).

TABLE VII

| | Mix 29 | Mix 30 | Mix 31 |
|---|---|---|---|
| PIBSA-based emulsifier | 2.0 | 2.0 | 2.0 |
| Sorbitan sesquioleate | 0.5 | 0.5 | 0.5 |
| Nitromethane | 23.0 | 12.0 | 6.0 |
| AN/SN liquor | 70.0 | 77.0 | 79.0 |
| Aluminum Fuel | — | 5.0 | 9.0 |
| Microballoons-glass | 3.5 | 3.5 | 3.5 |
| Oxygen balance | −2.0 | −0.64 | −1.45 |
| ASV(1) | 380 | 422 | 455 |
| RWS(2) | 101 | 112 | 121 |
| RBS(3)(1.25 g/cc) | 150 | 167 | 180 |
| Hardness | — | — | 190 |
| Rise in shear temperature °C. | — | — | −21 |
| Droplet size μ | | | |
| average $\bar{X}$ | — | — | 0.73 |
| % below 1 | — | — | 90.1 |
| Minimer Primer | R6 | R6 | R6 |
| VOD km/sec (50 mm diameter) | 4.9 | 5.0 | 4.7 |

(1)Absolute strength value
(2)Relative weight strength
(3)Relative bulk strength Table VIII, below, demonstrates the emulsifying ability of some derivatives of PIBSA-based and sorbitan-based emulsifiers in the emulsification of nitromethane explosives.

PICDEA alone cannot emulsify nitromethane (Mix 32). Its emulsifying ability is slightly poorer than that of, for example, the emulsifier used in Mix 16 in Table IV.

Among sorbitan-based surfactants, sorbitan mono, sesqui and trioleate, sorbitan sesquioleate shows better emulsifying effect than sorbitan mono and trioleate. (Mixes 33, 34 and 36)

Combination of the PIBSA-based emulsifier and SMO (Mix 35) is not as efficient as the combination to the PIBSA-based emulsifier and SSO (Mix 17, Table IV).

From the above, it is seen that the PIBSA-based emulsifier and SSO combination provides a most satisfactory mixture in producing emulsion explosives containing nitromethane as the continuous phase.

TABLE VIII

| | Mix 32 | Mix 33 | Mix 34 | Mix 35 | Mix 36 |
|---|---|---|---|---|---|
| E-476 (1) | — | — | — | 2.0 | — |
| PICDEA (2) | 3.0 | — | — | — | — |
| SPAN*80 (3) | — | 3.0 | — | 0.5 | — |
| ARLACEL* (4) | — | — | 3.0 | — | — |
| SPAN* 85 (5) | — | — | — | — | 3.0 |
| Nitromethane | 6.0 | 6.0 | 6.0 | 6.0 | 6.0 |
| AN/SN liquor | 87.0 | 87.0 | 87.0 | 87.5 | 87.5 |
| Microballoons-glass | 4.0 | 4.0 | 4.0 | 4.0 | 4.0 |
| Density, g/cc | — | — | 1.17 | 1.17 | — |
| Hardness | — | — | +200 | 160 | — |
| Rise in shear temperature °C. | — | — | −25 | −21 | — |
| Droplet size μ | | | | | |
| average $\bar{X}$ | — | — | 0.76 | 0.84 | — |
| % below 1 | — | — | 90.6 | 76.1 | — |
| Minimer Primer | — | — | R6 | R6 | — |
| VOD km/sec | — | — | 4.1 | 3.8 | — |
| NOTES: | Not Formed | Not Formed | Crystallized at −35° C. | Poor Emulsion Partially Crystallized | Not Formed |

(1) PIBSA-based emulsifier from Imperial Chemical Industries PLC
(2) PIBSA-based coco diethanol amide
(3) Sorbitan monooleate from Atkemix
(4) Sorbitan sequiolete from Atkemix
(5) Sorbitan trioleate from Atkemix
*Reg. Trade Mark The preferred inorganic oxygen-supplying salt suitable for use in the discontinuous aqueous phase of the water-in-fuel emulsion composition is ammonium nitrate. However, a portion of the ammonium nitrate may be replaced by other oxygen-supplying salts, such as alkali or alkaline earth metal nitrates, chlorates, perchlorates or mixtures thereof. The quantity of oxygen-supplying salt used in the composition may range from 30% to 90% by weight of the total.

The amount of water employed in the discontinuous aqueous phase will generally range from 5% to 25% by weight of the total composition.

Suitable nitroalkane fuels which may be employed in the emulsion explosives comprise nitromethane, nitroethane and nitropropane. The quantity of nitroalkane fuel used may comprise from 3% to 25% or lighter by weight of the total composition.

Suitable water-immiscible fuels which may be used in combination with the nitroalkane fuels include most hydrocarbons, for example, paraffinic, olefinic, naphthenic, elastomeric, saturated or unsaturated hydrocarbons. Generally, these may comprise up to 50% of the total fuel content without deleterious affect.

Occluded gas bubbles may be introduced in the form of glass or resin microspheres or other gas-containing particulate materials. Alternatively, gas bubbles may be generated in-situ by adding to the composition and distributing therein a gas-generating material such as, for example, an aqueous solution of sodium nitrite.

Optional additional materials may be incorporated in the composition of the invention in order to further improve sensitivity, density, strength, rheology and cost of the final explosive. Typical of materials found useful as optional additives include, for example, emulsion promotion agents such as highly chlorinated paraffinic hydrocarbons particulate oxygen-supplying salts, such as prilled ammonium nitrate, calcium nitrate, perchlorates, and the like, ammonium nitrate/fuel oil mixtures (ANFO), particulate metal fuels such as alumium, silicon and the like, particulate non-metal fuels such as sulphur, gilsonite and the like, aromatic hydrocarbons such as benzene, nitrobenzene, toluene, nitrotoluene and the like, particulate inert materials, such as sodium chloride, barium sulphate and the like, water phase or hydrocarbon phase thickeners, such as guar sum, polyacrylamide, carboxymethyl or ethyl cellulose, biopolymers, starches, elastomeric materials, and the like, crosslinkers for the thickeners, such as potassium pyroantimonte and the like, buffers or pH controllers, such as sodium borate, zinc nitrate and the like, crystals habit modifiers, such as alkyl naphthalene sodium sulphonate and the like, liquid phase extenders, such as formamide, ethylene glycol and the like and bulking agents and additives of common use in the explosives art.

The PIBSA-based emulsifier component of the essential emulsifier mixture may be produced by the method disclosed by A. S. Baker in Canadian Patent No. 1,244,463. The sorbitan mono-, di- and tri-sesquioleate and components of the essential emulsifier mixture may be purchased from commercial sources.

The preferred methods for making the water-in-fuel emulsion explosives compositions of the invention comprise the steps of:

(a) mixing the water, inorganic oxidizer salts and, in certain cases, some of the optional water-soluble compounds, in a first premix;

(b) mixing the nitroalkane fuel, emulsifying agent and any other optional oil soluble compounds, in a second premix; and (c) adding the first premix to the second premix in a suitable mixing apparatus, to form a water-in-fuel emulsion.

The first premix is heated until all the salts are completely dissolved and the solution may be filtered if needed in order to remove any insoluble residue. The second premix is also heated to liquefy the ingredients. Any type of appartus capable of either low or high shear mixing can be used to prepare the emulsion explosives of the invention. Glass microspheres, solid fuels such as aluminum or sulphur, inert materials such as barytes or sodium chloride, undissolved solid oxidizer salts and other optional materials, if employed, are added to the microemulsion and simply blended until homogeneously dispersed throughout the composition.

The water-in-fuel emulsion of the invention can also be prepared by adding the second premix liquefied fuel solution phase to the first premix hot aqueous solution phase with sufficient stirring to invert the phases. However, this method usually requires substantially more energy to obtain the desired dispersion than does the preferred reverse procedure. Alternatively, the emulsion is adaptable to preparation by a continuous mixing process where the two separately prepared liquid phases are pumped through a mixing device wherein they are combined and emulsified.

The emulsion explosives herein disclosed and claimed represent an improvement over more conventional oil/-waxes fueled emulsions in many respects. In addition to providing a practical means whereby high energy nitroalkane fuels may be emulsified with saturated aqueous salt solutions, the invention provides an explosive of desirable properties. These include high strength, good sensitivity, especially at low temperatures, variable hardness, adequate resistance to desensitization caused by exposure to shock or shear, intimate contact of the phases due to small droplet size and ease of oxygen balance with low toxic fume production.

The examples herein provided are not to be construed as limiting the scope of the invention but are intended only as illustrations. Variations and modifications will be evident to those skilled in the art.

While the present invention is directed towards an explosive emulsion, one skilled in the art will be readily able to use the emulsions of the present invention as propellants by varying the rate of propagation of the explosive by techniques known in the art. Accordingly, the term "emulsion explosive composition" are used in the present invention includes emulsions used as both propellants and explosives, per se.

I claim:

1. A water-in-fuel emulsion explosive composition comprising:

(A) a liquid or liquefiable fuel consisting of a nitroalkane compound forming a continuous emulsion phase;

(B) an aqueous solution of one or more inorganic oxidizer salts forming a discontinuous phase; and (C) an effective amount of a polyisobutyl succinic anhydride-based emulsifying agent.

2. An explosive composition as claimed in claim 1 wherein said nitroalkane compound is selected from the group consisting of nitromethane, nitroethane and nitropropane and mixtures thereof.

3. An explosive composition as claimed in claim 2 wherein part of the said nitroalkane compound is replaced by a water-immiscible hydrocarbon.

4. An explosive composition as claimed in claim 1 wherein the oxidizer salt is ammonium nitrate.

5. An explosive composition as claimed in claim 4 wherein up to 50% by weight of the ammonium nitrate is replaced by one or more inorganic salts selected from the group of alkali and alkaline earth metal nitrates and perchlorates.

6. An explosive composition as claimed in claim 1 wherein said polyisobutyl succinic anhydride-based emulsifying agent is the reaction product of:

(i) a polyalk(en)yl succinic anhydride which is the addition product of a polymer of a mono-olefin containing 2 to 6 carbon atoms, and having a terminal unsaturated grouping with maleic anhydride, the polymer chain containing from 30 to 500 carbon atoms; and (ii) a polyol, a polyamine, a hydroxyamine, phosphoric acid, sulphuric acid or monochloroacetic acid.

7. An explosive composition as claimed in claim 6 wherein composition comprises an emulsifier mixture of said polyisobutyl succinic anhydride-based emulsifying agent and a mono-, di-, or tri-ester of 1–4 sorbitan and oleic acid, or mixtures thereof.

8. An explosive composition as claimed in claim 7 wherein the said emulsifying mixture comprises up to 10% by weight of the total composition.

9. An explosive composition as claimed in claim 7 wherein the ratio of sorbitan ester emulsifier to polyisobutyl succinic anhydride-based emulsifier is from 1:1 to 1:10.

10. An explosive composition as claimed to claim 7 wherein the ratio of sorbitan ester emulsifier to polyisobutyl succinic anhydride-based emulsifier is from 1:1 to 1:5.

11. An emulsion explosive of the water-in-fuel type consisting essentially of:

(A) a discontinuous phase comprising 5–25% by weight of water and from 30–95% by weight of one or more soluble inorganic oxidizer salts;

(B) a continuous phase comprising from 3–25% by weight of a nitroalkane compound; and (C) an effective amount of an emulsifying agent comprising up to 10% by weight of the total composition, the said emulsifying agent comprising a mixture of:

(a) an amount of a polysobutyl succinic anhydride-based compound which is the reaction product of:

(i) a polyalky(en)yl succinic anhydride which is the addition product of a polymer of a monoolefin containing 2 to 6 carbon atoms, and having a terminal unsaturated grouping with maleic anhdride, the polymer chain containing from 30 to 500 carbon atoms; and (ii) a polyol, a polyamine, a hydroxyamine, phosphoric acid, sulphuric acid or monochloroacetic acid; and (b) an amount of mono-, di- or tri-ester of 1–4 sorbitan and oleic acid.

12. An explosive compsition as claimed in claim 11 wherein the ratio of sorbitan ester emulsifier to polyisbutyl succinic anhydride-based emulsifier is from 1:1 to 1:10.

* * * * *